United States Patent [19]

Graziano

[11] 4,347,831

[45] Sep. 7, 1982

[54] FUEL BURNING STOVE

[76] Inventor: Peter Graziano, Rte. 4, Eau Claire, Wis. 54701

[21] Appl. No.: 67,466

[22] Filed: Aug. 17, 1979

[51] Int. Cl.[3] ..... F24C 15/28; F24C 1/14; F23L 3/00

[52] U.S. Cl. ..... 126/83; 126/77; 126/58; 126/67; 126/285 A

[58] Field of Search ..... 126/58, 83, 67, 77, 126/285 A

[56] References Cited

U.S. PATENT DOCUMENTS

| | | | |
|---|---|---|---|
| 1,287,051 | 12/1918 | Lakin | 126/58 |
| 1,567,364 | 12/1925 | Gaddis | 126/58 |
| 2,443,910 | 6/1948 | Higley | 126/83 |
| 4,204,517 | 5/1980 | Rumsey | 126/83 |

*Primary Examiner*—Samuel Scott

*Assistant Examiner*—Wesley S. Ratliff, Jr.

*Attorney, Agent, or Firm*—Burd, Bartz & Gutenkauf

[57] ABSTRACT

A fuel burning stove or furnace wherein combustion of fuel is more complete resulting in a greater amount of heat generation and a cleaner combustion residue. The stove includes a stove housing defined by side walls and top and bottom walls and having an unobstructed combustion chamber. A flue has a flue passage to the combustion chamber at the lower portion thereof beneath the normal combustion area within the chamber. Unburned gaseous products of combustion rise toward the top of the chamber and are trapped and forced back downward through the chamber into the flue passage. As they pass again through the flame of combustion, the unburned products are burned. The result is more efficient combustion and a cleaner combustion residue. The residue is less pollutant and is safer in terms of avoiding chimney fires.

3 Claims, 6 Drawing Figures

Fig. 3
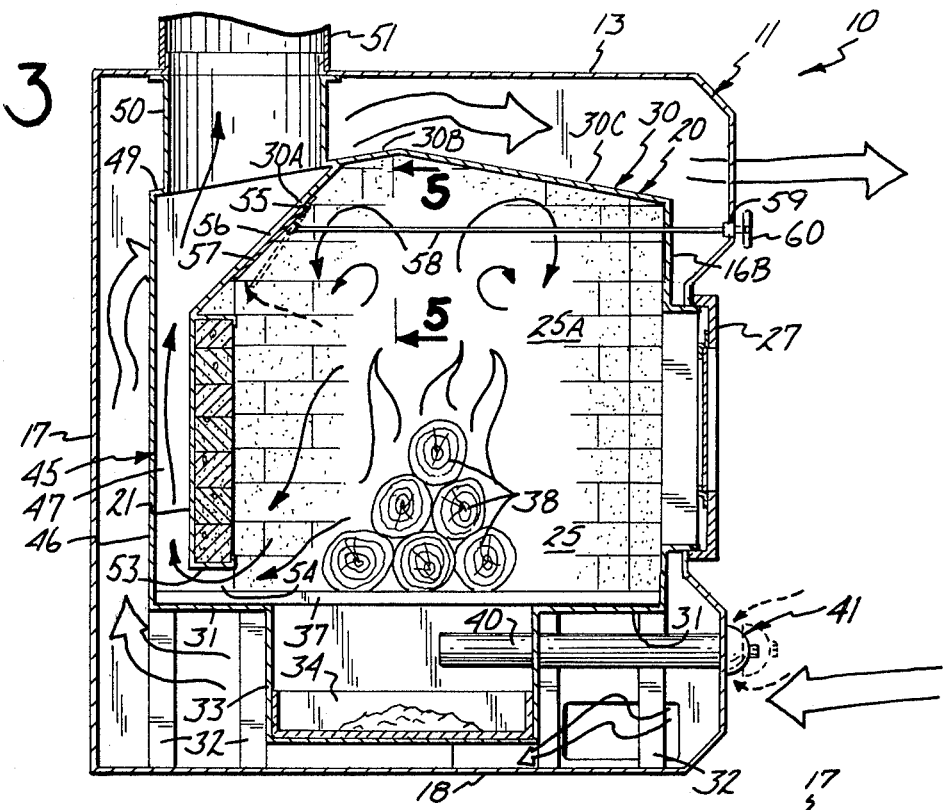
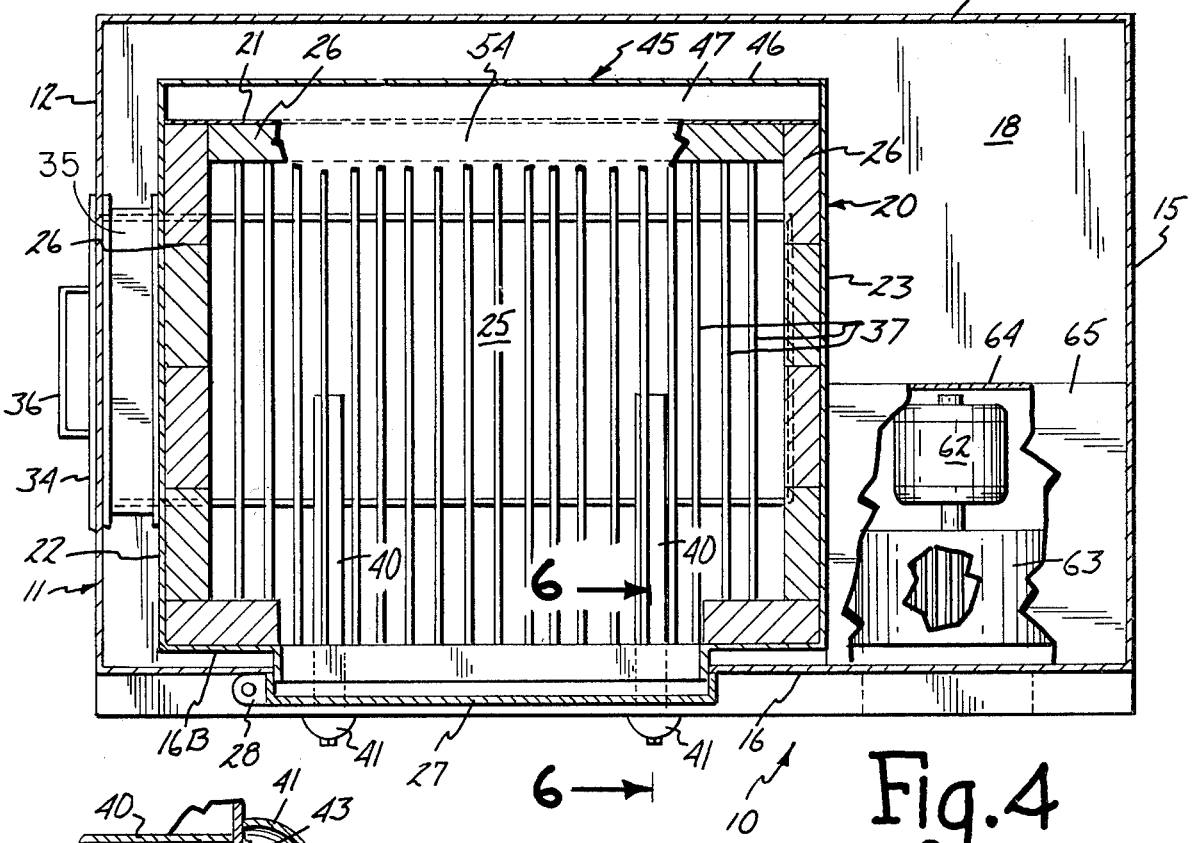
Fig. 4
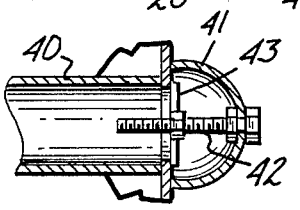
Fig. 6

FUEL BURNING STOVE

SUMMARY OF THE INVENTION

The invention relates to a stove or furnace of the type that burns fuel for purposes of obtaining room heat such as a wood burning stove. In such stoves, combustion of the fuel is usually incomplete. Among the products released from combustion are unburned combustible gases resulting in not only inefficient expenditure of fuel but also a more pollutant residue.

The present invention contemplates a fuel burning stove or furnace wherein combustion of the fuel is more complete resulting in a greater amount of heat generation from a given amount of fuel and a cleaner combustion residue. The stove includes a stove housing comprised of side walls and top and bottom walls defining an unobstructed combustion chamber. Fuel is burned proximate the bottom wall or floor of the chamber providing combustion in a combustion space located intermediate the top and bottom walls. A flue is provided to carry products of combustion from the combustion chamber. The flue is open to the lower portion of the combustion chamber beneath the combustion space of the chamber. The remainder of the chamber is normally closed. When combustion occurs, the products of combustion, including unburned combustible gases, rise toward the upper portion of the chamber. The combustion products cannot escape at the closed upper portion of the chamber and are forced back downwardly to the flue opening being forced to pass through the flames of combustion. Combustion gases which were initially unburned pass through the combustion flame on a path to the flue opening. Consequently, the combustion products that pass through the flue opening are substantially rid of uncombusted gas vapors. The fuel is burned more efficiently and the exhaust is cleaner.

A closable damper can be provided in the upper portion of the combustion chamber leading to the flue for the initial ignition of a fire in the combustion chamber to create a proper draft in the flue.

IN THE DRAWINGS

FIG. 3 is a sectional view of the stove shown in FIG. 2 taken along the line 3—3 thereof;

FIG. 4 is a sectional view of the stove of FIG. 2 taken along the line 4—4 thereof;

FIG. 6 is an enlarged view partly in section showing air inlet draft control of the stove.

DESCRIPTION OF PREFERRED EMBODIMENT

Figure 1:
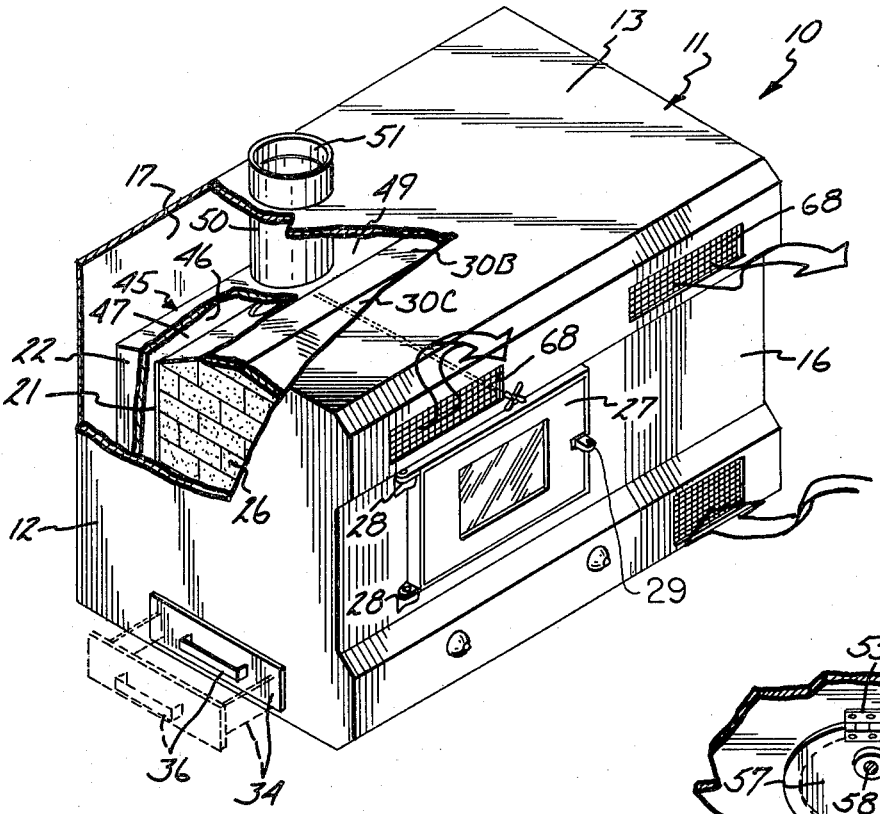
FIG. 1 is a perspective view of a wood burning stove according to the present invention with portions removed for purposes of illustration.
Figure 5:
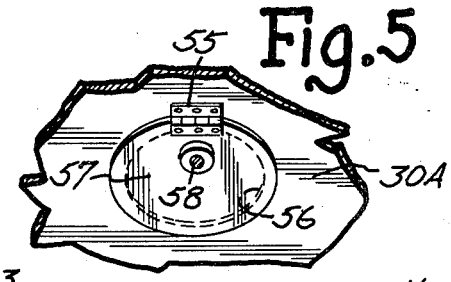
FIG. 5 is an enlarged view of a portion of the stove shown in FIG. 3 taken along the line 5—5 thereof.
Figure 2:
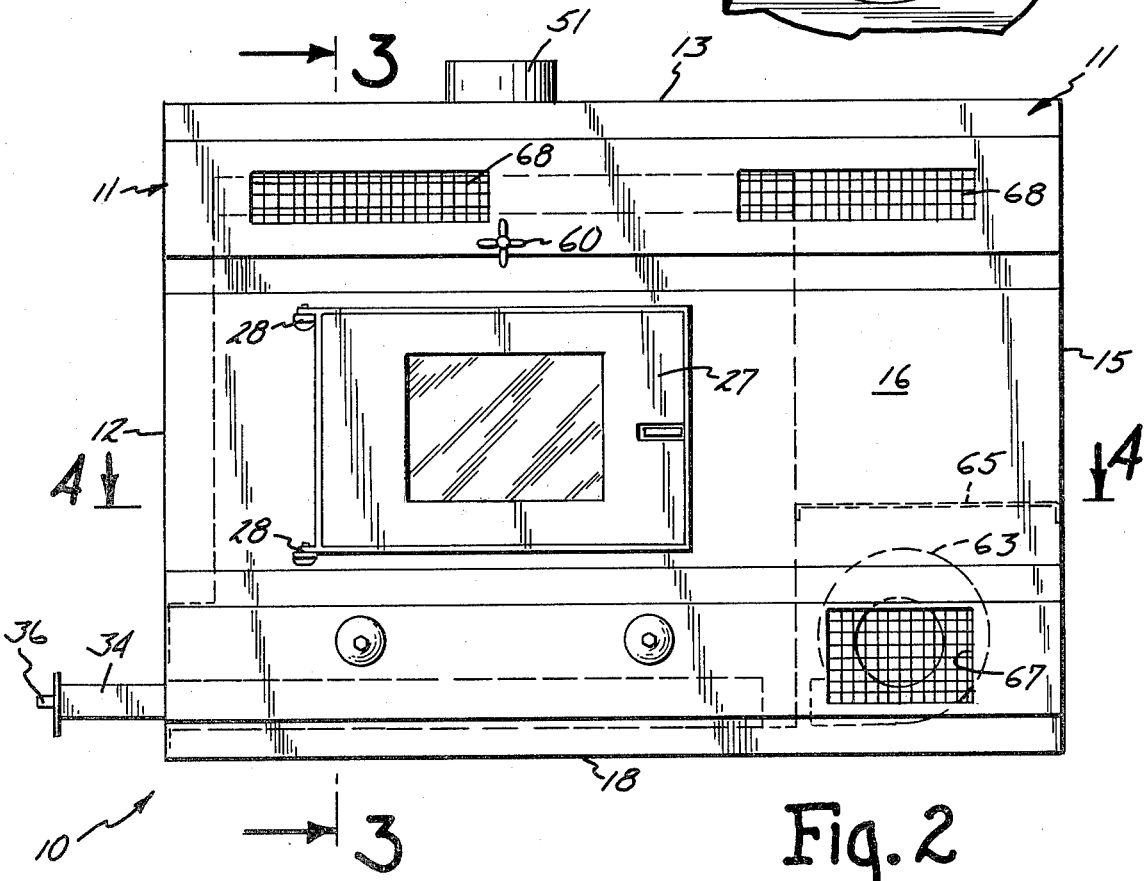
FIG. 2 is an enlarged front elevational view of the stove of FIG. 1.

Referring to the drawings, there is shown in FIGS. 1 through 3 a wood burning stove indicated generally at 10. Stove 10 can burn wood, coal, paper and like combustible fuel. Stove 10 has an outer closed cabinet 11 including a left side wall 12, a top wall 13 and a right side wall 15. Front and rear walls 16,17 are provided joined to the side and top walls, and a bottom wall 18 closes the lower end of cabinet 11.

A stove housing 20 is situated within the outer cabinet 11. Stove housing 20 includes a rear side wall 21 joined to lateral side walls 22,23. A front wall 16A of stove housing 20 is formed of a common portion of front wall 16 of outer cabinet 11. The front, rear and side walls of stove housing 20 define an unobstructed combustion chamber 25. The side walls and rear wall of stove housing 20 are lined with a fire brick 26. A door 27 with a handle 29 is mounted on hinges 28 on front wall 16A for access to combustion chamber 25. A top wall of stove housing 20 enclosing combustion chamber 25 comprises a rearwardly slanted portion 30A connected to the rear wall 20, an upper portion 30B connected to the upper edge of the rearward portion 30A, and a forwardly slanted portion 30C connected between the top portion 30B and an upper forward wall portion 16B.

A bottom wall 31 closes the bottom of stove housing 20 and is supported in cabinet 11 by legs 32 to support the stove housing 20. Bottom wall 31 includes a recessed, upwardly open transversely disposed ash box 33 which carries an ash drawer 34. As shown in FIG. 1, ash drawer 34 is movable in and out through a suitably provided opening in the left side wall 12 of cabinet 11 so that it can be emptied and cleaned. A suitable handle 36 is provided on the end of ash drawer 34 to facilitate this purpose. Ash box 33 extends beyond side wall 22 of stove housing 20 and abuts cabinet side wall 12. A plate 35 extends between stove housing side wall 22 and cabinet side wall 12 in covering relationship to the extended portion of ash box 33.

Forward and rearward edges of a grate 37 rest on the upper surface of bottom wall 31 with grate 37 in spanning relationship to the opening of ash box 33. Fuel such as logs 38 can be situated on the grate 37 above ash box 33 for combustion.

A pair of hollow tubular draft inlet pipes 40 are mounted in the lower portion of front wall 16 of cabinet 11 and extend through the side wall of ash box 33 to a location within the volume encompassed by ash box 33 to provide a draft inlet passage to combustion chamber 25. Draft pipes 40 provide a draft for combustion in combustion chamber 25. Adjustable draft inlet means on the outer ends of draft pipes 40, as shown in FIG. 6, includes a cup 41 mounted in covering relationship to the outer end of draft pipe 40. A bolt 42 is threaded to a bracket 43 which spans the opening of draft pipe 40. Bolt 42 also passes through and is fixed to cup 41 such that rotation of bolt 42 is effective to move the cup 41 toward and away from the edges of front wall 16 defining the opening to draft pipe 40 to admit more or less draft air.

Housing 20 includes a flue 45 comprised of a vertical flue wall 46 in parallel relationship to and rearwardly spaced from the rear wall 21 of housing 20. The lower edge of flue wall 46 joins the rear edge of bottom wall 21 extended beyond rear wall 21 of housing 20. The vertical edges of flue wall 46 join the rear vertical edges of housing side walls 22,23 extended rearwardly of rear wall 21 to form a closed flue chamber 47. A flue top wall, shown at 49 in FIG. 1, joins the upper edges of the vertical flue wall 46 and side walls 22,23 to close the upper end of flue chamber 47. A flue stack 50 extends from the flue top wall 49 and joins a flue pipe 51 situated on the outer surface of top wall 13 of cabinet 11. Flue pipe 51 can lead to the usual chimney to exhaust products of combustion from the building in which the stove is located.

The lower edge of rearward wall 21 of housing 20 is comprised of a horizontal lip 53 which supports a fire brick 26 and is spaced from the bottom wall 31 to form a flue passage 54 between the combustion chamber 25 and the flue chamber 47 coextensive with the length of the rearward wall 21. Flue passage 54 is located somewhat beneath the combustion area 25A of combustion chamber 25 and is located above the draft inlet provided by the draft pipes 40. During normal combustion, products of combustion pass from the combustion chamber 25 through the flue passage 54 in order to escape through the flue chamber 45, flue stack 50 and flue pipe 51.

A damper opening 56 in the rearwardly inclined section 30A of the top wall of housing 20 is normally closed by a damper 57 connected by hinge 55 along an edge of the opening 56. A damper control rod 58 is pivotally assembled at one end to the damper 57 and extends through the fire chamber 25 and through a suitable opening in the upper front wall portion 16B of housing 20. The opposite end of damper control rod 58 extends out of the front wall 16 of cabinet 11 and threadably engages a coupling 59 located thereon. Control handle 60 is fixed to the outward end of damper control rod 58. Rotation of the handle 60 moves the damper control rod 58 in and out to open and close the damper 57 with respect to the damper opening 56. Damper 57 is opened when solid fuel is initially ignited in combustion chamber 25. Damper 57 is opened at such time as ignition is commenced in order that a draft can be created in the flue stack 50 and flue pipe 51. Once a draft is created and combustion is well under way, damper 57 is closed and the products of combustion are exhausted through the flue passage 54.

In the use of the stove of the embodiment of the invention shown, solid fuel, such as the logs 38, is loaded through open door 27 and properly arranged on grate 37. With damper 57 open and inlet draft control 41 properly adjusted, the fuel is ignited and the door 27 is closed. Combustion occurs in the combustion area 25A of combustion chamber 25 intermediate between grate 37 and top wall 30. A chimney draft is created through the damper opening 56. Once combustion is established, the damper 57 is closed. Combustion products are then exhausted through the flue opening 54. As combustion occurs, combustion products rise in the combustion chamber 25 and include unburned combustible gases. There is no provision for escape from the upper portion of combustion chamber 25, and the combustion products are forced downward toward the flue opening 54. As the combustion products pass downward, they again pass through the flame and heat of combustion in the combustion area 25A. At that location, unburned gases that again pass through the flame and heat are combusted prior to passage of the flue opening 54. A greater amount of heat is thus derived from the flue and the exhaust or combustion residue that passes through the flue passage 54 is cleaner. The cleaner residue is not only less pollutant but is safer in terms of avoiding chimney fires. Having exhausted through flue passage 54, the products of combustion continue up through flue chamber 47 and then through flue stack 50 and flue pipe 51 to be exhausted in the usual manner.

The walls of cabinet 11 surround stove housing 20 and are spaced from it to provide a space for circulation of room air about stove housing 20 to be warmed and discharged back into the room. As shown in FIG. 4, an electric motor 62 is located in a lower portion of cabinet 11 that is extended laterally from the stove housing 20. Motor 62 is operatively connected to a blower 63. Blower 63 and motor 62 are enclosed by a closure formed of a vertical wall 64, the downward extension of stove housing side wall 23, a horizontal wall 65, and the lower corner portion formed by cabinet side wall 15 and front wall 16. The blower 63 is orientated to draw air through a cabinet inlet opening 67 covered by a suitable screen and directed along the forward lower portion of cabinet 11. As shown by the wide arrows in FIG. 3, air circulates along the lower front portion of cabinet 11, around and under the stove housing 20, up between back wall 17 of cabinet 11 and flue wall 46 of stove housing 20, and through the space between top wall 30 of stove housing 20 and top wall 13 of cabinet 11. Air exits through cabinet outlet openings 68 located in the upper portion of the front wall 16 of cabinet 11 covered by suitable screens. The air has been thoroughly warmed as it returns back into the room.

While there has been shown and described one form of the invention, it will be apparent that other forms of the invention can be derived without departing from the scope and spirit of the invention. For example, fuel sources other than wood logs can be used and the invention has application to numerous types of fuel burning stoves and furnaces.

The embodiments of the invention in which an exclusive property or privilege is claimed are defined as follows:

1. A stove comprising:

a stove housing having top and bottom walls and side walls defining an unobstructed combustion chamber having a combustion area located intermediate between the top and bottom walls;

a grate for holding fuel in the combustion chamber located beneath the combustion area for combustion of fuel in the combustion area;

a flue including flue wall means spaced from one of the stove housing side walls and defining a flue chamber and an upper flue opening for exhaust of products of combustion, said one side wall having a bottom edge spaced from the grate to provide a flue passage in communication with the combustion chamber and the flue chamber at a location beneath the combustion area in the combustion chamber;

a damper opening located in one of said stove housing walls at a location above the combustion area, open to the flue chamber, and a closeable damper normally closing the damper opening and means to control the position of the damper with respect to the damper opening;

a draft inlet means to the combustion chamber to admit draft to the combustion chamber, said draft inlet means located at a position below the flue passage; and a cabinet surrounding the stove housing having cabinet walls spaced from the wall means and means for circulation of air in the space between the cabinet walls and the housing walls to warm said air and return it to the room.

2. The stove of claim 1 wherein: said draft inlet means includes draft inlet pipes extended through the cabinet and through the stove walls into the chamber.

3. The stove of claim 1 including: an electric motor and a blower mounted in the cabinet to circulate room air to be warmed in the space between the cabinet walls and the wall means.

* * * * *